United States Patent [19]

Isogawa et al.

[11] Patent Number: 4,919,629

[45] Date of Patent: Apr. 24, 1990

[54] STEERING DEVICE FOR MARINE PROPULSION

[75] Inventors: Atsushi Isogawa; Yukio Sumigawa, both of Hamamatsu, Japan

[73] Assignee: Sanshin Kogyo Kabushiki Kaisha, Hamamatsu, Japan

[21] Appl. No.: 150,548

[22] Filed: Feb. 1, 1988

[30] Foreign Application Priority Data

Jan. 31, 1987 [JP] Japan ..... 62-19665

[51] Int. Cl.[5] ..... B63H 21/26

[52] U.S. Cl. ..... 440/62; 440/63; 440/900

[58] Field of Search ..... 440/53, 62, 63, 900

[56] References Cited

U.S. PATENT DOCUMENTS

| | | | |
|---|---|---|---|
| 2,700,358 | 1/1955 | Johnson | 440/61 |
| 2,875,722 | 3/1959 | Post | 440/62 |
| 3,002,398 | 10/1961 | Beamer | 440/63 |
| 3,091,977 | 6/1963 | Kiekhaefer | 440/62 |
| 3,207,117 | 9/1965 | Nolen | 440/62 |
| 4,731,035 | 3/1988 | Wagner | 440/900 |

FOREIGN PATENT DOCUMENTS

| | | | |
|---|---|---|---|
| 144270 | 6/1985 | European Pat. Off. | 114/270 |

*Primary Examiner*—Sherman D. Basinger
*Assistant Examiner*—Thomas J. Brahan
*Attorney, Agent, or Firm*—Ernest A. Beutler

[57] ABSTRACT

An improved steering device for a marine propulsion unit that incorporates a steering bracket that is clamped to the transom of the associated watercraft in proximity to the tilt axis of the outboard drive. A steering rod is reciprocally supported in a bore in the steering bracket and is connected at one end to a push pull cable and at the other end to the steering arm of the outboard drive for effecting its steering.

11 Claims, 2 Drawing Sheets

STEERING DEVICE FOR MARINE PROPULSION

BACKGROUND OF THE INVENTION

This invention relates to a steering device for marine propulsion units and more particularly to an improved, simplified and compact steering device for such propulsion units.

As is well known, a common form of marine propulsion device consists of a drive shaft housing that carries a drive shaft which is driven by an internal combustion engine and which drives a propulsion device for propelling a watercraft through the water. The drive shaft housing is normally supported by means of a swivel bracket for steering movement of the drive shaft housing about a generally vertically extending axis. The swivel bracket is, in turn, pivotally connected to the transom of the watercraft for tilting movement of the drive shaft housing about a horizontally disposed axis for trim adjustment and for tilting up. In order to effect steering of the watercraft, a steering arm is affixed to the drive shaft housing and is connected to the watercraft steering system so that a remotely positioned operator can steer the watercraft. Normally, flexible, push-pull cables are employed for effecting the steering movement of the drive shaft housing. Although such an arrangement has particular utility, the fact that the outboard drive must both move about the steering axis and also pivot about a tilt axis gives rise to problems in connection with the connection of the push-pull cable to the steering arm.

In connection with larger outboard drives, the pivot pin that defines the tilt axis is relatively large and may be provided with a bore so as to support a portion of the steering mechanism, such as a reciprocating rod that is connected at one end to the push-pull cable and at the other end to the steering arm. However, in connection with smaller displacement outboard drives, such large diameter pivot pins are not employed and other arrangements are required for connecting the push-pull cables to the steering arm. In connection with the smaller displacement applications, the encircling protective sheath of the push-pull cable must be affixed either to the transom of the watercraft or to some other component of the watercraft that does not move during the steering movement. As a result, the problem of binding and interference is quite typical with such smaller displacement outboard drives.

It is, therefore, a principal object of this invention to provide an improved steering device for a marine propulsion unit.

It is a further object of this invention to provide an improved steering device that may be used in conjunction with small displacement outboard drives and which does not necessitate any significant change to the construction of the outboard drive per se.

It is a further object of this invention to provide a detachable steering device for use with marine outboard drives that will afford ease of attachment of a remote steering mechanism to the outboard drive without resulting in interference or restrictive movement of the outboard drive in either the steering or tilt directions.

SUMMARY OF THE INVENTION

This invention is adapted to be embodied in a steering device for a marine propulsion device that is adapted to be affixed relative to the transom of a watercraft. The propulsion device comprises a drive shaft housing that rotatably journals an engine driven shaft. A swivel bracket journals the drive shaft housing for steering movement about a generally vertically extending steering axis. Pivot pins means interconnect the swivel bracket to a clamping bracket for pivotal movement of the drive shaft housing and swivel bracket about a generally horizontally extending tilt axis. A steering arm is affixed to the drive shaft housing. In accordance with the invention, a steering bracket is affixed between the clamping bracket and the transom and defines a bore that extends generally parallel to and offset from the tilt axis. A steering rod slidably supported in the bore for reciprocation. Means are incorporated for affixing an operator controlled steering cable to the steering rod for effecting operator controlled reciprocation of the steering rod. Means also connect the steering rod to the steering arm for steering of the drive shaft housing upon reciprocation of the steering rod.

DETAILED DESCRIPTION OF THE PREFERRED EMBODIMENTS

Figure 1:
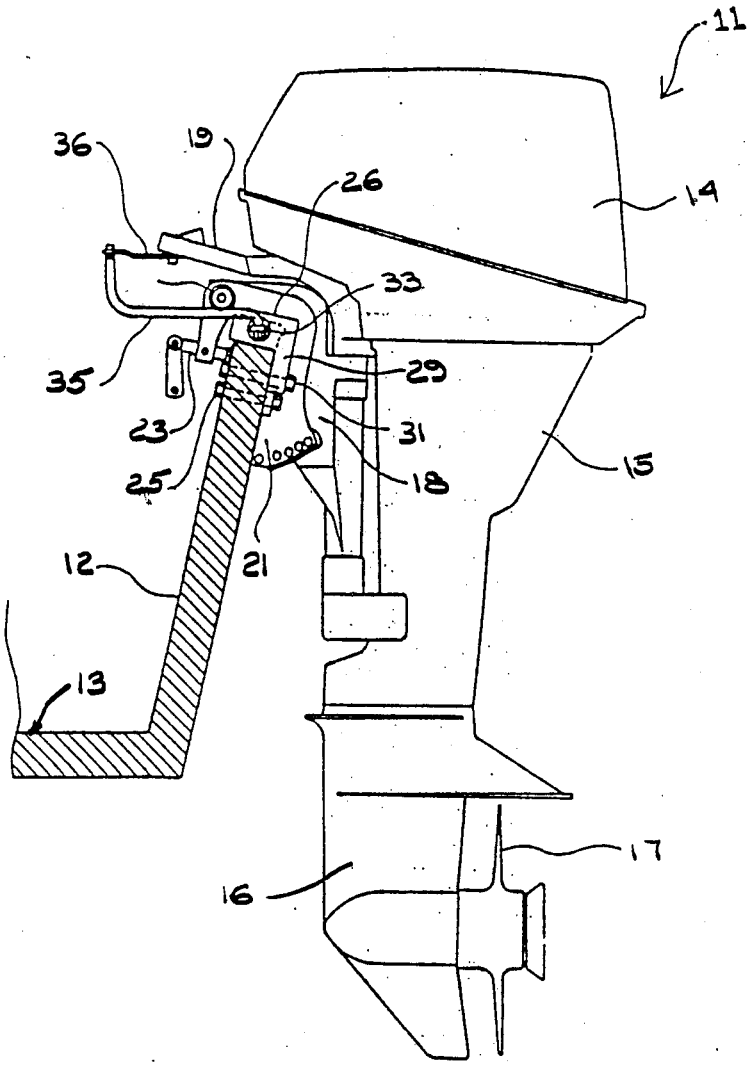
FIG. 1 is a side elevational view of an unboard motor embodying a steering device constructed in accordance with an embodiment of the invention, as attached to the transom of an associated watercraft.
Figure 2:
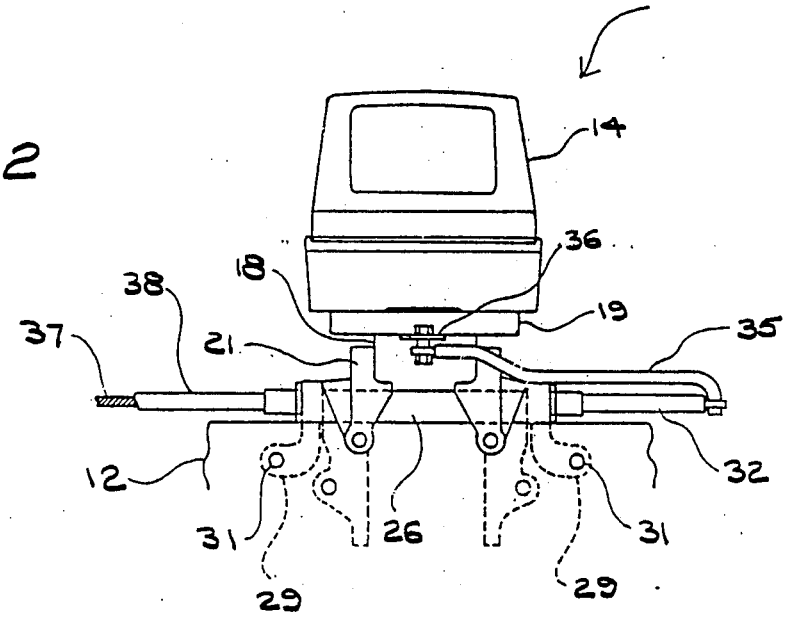
FIG. 2 is a front view of the outboard motor and transom.

Referring first primarily to FIGS. 1 and 2, an outboard motor, indicated generally by the reference numeral 11 is depicted as attached to a transom 12 of a watercraft which is shown partially and is identified generally by the reference numeral 13. The invention is described in conjunction with an outboard motor 11; however, it is to be understood that the invention may be equally as well practiced with the outboard drive portion of an inboard-outboard drive. The invention does have particularly utility with outboard motors that are designed to be attached as a separate unit to the transom of a watercraft and particularly to small displacement outboard motors.

The outboard motor 11 is comprised of a power head 14 that consists of an internal combustion engine (not shown) and which may be of any known type and which is enclosed within a protective cowling. A drive shaft housing 15 depends from the power head 14 and contains a drive shaft (not shown) that is driven by the output shaft of the power head engine. This drive shaft, in turn, drives a forward, neutral, reverse transmission (not shown) that is contained within a lower unit 16 for driving a propeller 17 in selected forward or reverse directions.

A steering shaft (not shown) is affixed to the drive shaft housing 15 in a known manner and is journaled within a swivel bracket 18 for steering movement about a generally vertically extending steering axis. A steering arm 19 is affixed to the upper end of the steering shaft for effecting operator controlled steering of the drive shaft housing 15 about this steering axis and, accordingly, steering of the outboard motor 11 and watercraft 13 in a known manner.

The swivel bracket 18 is pivotally connected to a clamping bracket 21 by means including a horizontally extending pivot pin 22. This pivotal connection permits trim adjustment of the outboard motor 11 and also permits the outboard motor 11 to be tilted up to an out of the water condition, as is well known in this art. A clamping device 23 of the screw type is incorporated and acts on a swivel 24 (FIG. 4) so as to affix the clamping bracket 21 to the transom 12. Fastening bolts 25 may also pass through the transom 12 for affording a more permanent attachment of the clamping bracket 21 to the watercraft 13.

The construction as thus far described may be considered to be conventional and since the aforedescribed construction forms no part of the invention but rather the environment in which the invention may be practice, a more detailed description of the construction is believed to be unnecessary in order to understand the invention.

Figure 3:
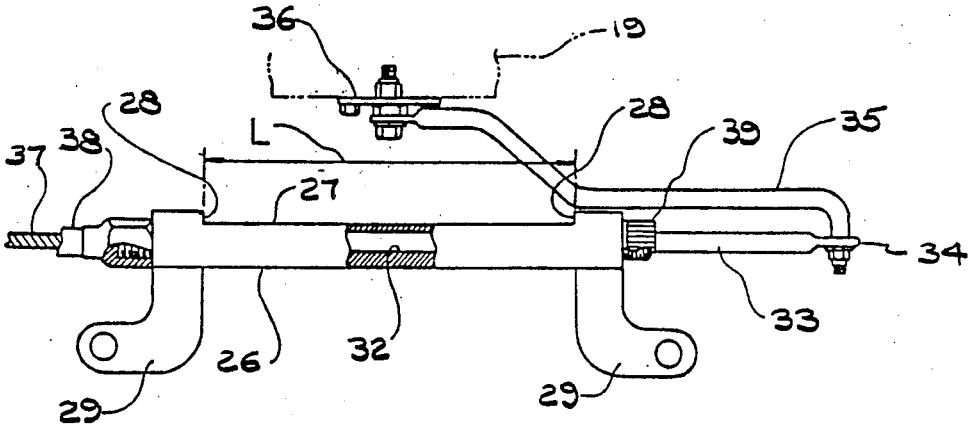
FIG. 3 is an enlarged front elevational view of the steering mechanism.
Figure 4:
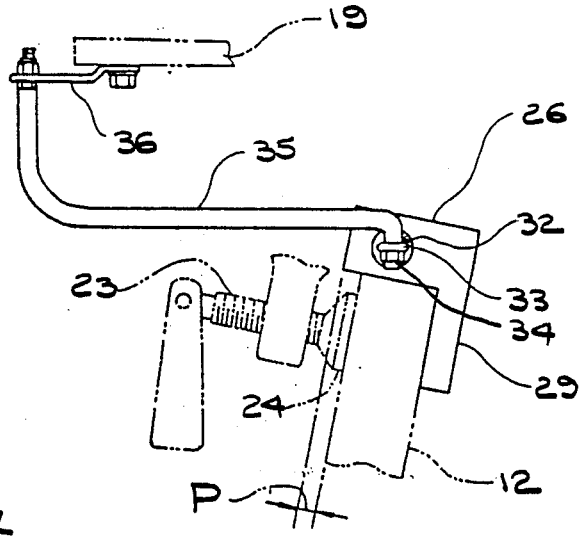
FIG. 4 is an enlarged side elevational view of the steering mechanism, with components of the watercraft and outboard motor shown in phantom.

In accordance with the invention, an arrangement is provided for facilitating remote steering of the outboard motor 11 by means of a remotely positioned steering wheel (not shown). This steering mechanism comprises a steering bracket 26 that is, in the illustrated embodiment, adapted to be interposed between the clamping bracket 21 and the transom 12. The steering bracket 26 has a configuration as best shown in FIGS. 3 and 4 and is comprised of a generally elongated portion that is slightly wider than the width of the transom so as to provide an overlap P as shown in FIG. 4. This overlapping portion is, however, provided with a recess 27 that is defined by a pair of inwardly facing shoulders 28. The recess 27 is sized so as to provide a thickness substantially the same as the thickness of the transom 12 so that the clamping bracket 21 may still coooperate with the transom 12 in the same manner as had the steering bracket 26 not be interposed. The outwardly facing edges of the clamping bracket 21 are adapted to be engaged with the shoulders 28 spaced at the distance L so as to provide for location of the outboard motor 11 relative to the steering bracket 26 so that these components will be relatively rigidly affixed to each other.

The steering bracket 26 is provided with a pair of downwardly extending lugs 29 that are designed to extend on the rear face of the transom 12 and which may be clamped to the transom 12 by means of bolt and nut assemblies 31. It should be noted that the depending portions 29 are positioned in a vertical alignment with the clamping swivels 24 of the clamping bracket clamps 23 so that the loads applied by the clamping screws 23 will be applied in proximity to the lugs 29.

A bore 32 extends through the steering bracket 26 which bore 32 is generally parallel to the tilt pivot pin 22 when the unit is assembled as shown in FIG. 1 and which is disposed below and slightly rearwardly of it as shown in this figure. This close positioning of the bore 32 and the tilt pivot pin 22 reduces the likelihood of interference on tilting movement of the outboard motor 11, as will become apparent.

A steering rod 33 is supported for reciprocation within the bore 32. The steering rod 33 has an extending end part that is connected by means of a coupling 34 to one end of an offset steering link 35. The steering link 35 is connected at its opposite end to a bracket 36 that is affixed to the steering arm 19 so as to afford steering movement of the steering arm 19 upon reciprocation of the steering rod 33 in the bore 32.

The end of the steering rod 33 opposite the connection 34 to the steering link 35 is connected to one end of a flexible push-pull cable 37 in an appropriate manner. The protective sheath 38 of the push-pull cable 37 bears against one end of the steering bracket 27 and is held in such engagement by a clamping nut 39 encircling the opposite end of the steering rod 33. As a result, reciprocation of the push-pull cable 37 will effect reciprocation of the steering rod 33 and steering of the outboard motor 11 in the manner as aforedescribed. This steering mechanism provides extremely good movement and avoids the likelihood of interference of the steering mechanism with the steering and tilt movements of the outboard motor 11. It should be noted that the steering rod 33 may rotate slightly when the outboard motor 11 is tilted to its various trim positions and also when the outboard motor 11 is tilted up to its out of the water position. Because of the close placement of the axes defined by the pivot pin 22 and the bore 32, interference is minimized and either flexibility of the bracket 36 or the joint 34 may accommodate such movement, if necessary.

In the described embodiment, the steering bracket 26 is a separate component that was interposed between the clamping bracket 21 and the transom 12. It is to be understood that the steering bracket 26 may be formed integrally with the clamping bracket 21 but the separate construction permits adaptation of the steering mechanism to all existing outboard motors without any change to them.

It is to be understood that the foregoing described embodiments are only preferred embodiments of the invention and that various changes and modifications may be made without departing from the spirit and scope of the invention, as defined by the appended claims.

We claim:

1. A steering device for a marine propulsion device affixed relative to the transom of a watercraft, said propulsion device comprising a drive shaft housing rotatably journaling an engine driven shaft, a swivel bracket journaling said drive shaft housing for steering movement about a generally vertically extending steering axis, a generally "C" shaped clamping bracket adapted to receive the upper end of the transom for affixing said propulsion device to the transom, pivot pin means interconnecting said swivel bracket and said clamping bracket for pivotal movement about a generally horizontally extending tilt axis, and a steering arm affixed to said drive shaft housing, the improvement comprising a steering bracket affixed between a downwardly extending face of said clamping bracket and an upwardly extending face of the transom, said clamping bracket extending over said steering bracket for direct attachment to the transom, said steering bracket defining a bore extending generally parallel to and offset from said tilt axis, a steering rod slidably supported in said bore for reciprocation relative thereto, means for affixing an operator controlled steering cable to said steering rod for effecting operator controlled reciprocation of said steering rod, and means connecting said steering rod to said steering arm for steering of said drive shaft housing upon reciprocation of said steering rod.

2. A steering device as set forth in claim 1 wherein the steering bracket is clamped to the transom independently of the clamping bracket.

3. A steering device as set forth in claim 2 wherein the steering bracket is affixed to the transom on the opposite side of the transom from the clamping bracket.

4. A steering device as set forth in claim 2 wherein the steering bracket forms a piece separate from the transom and the clamping bracket.

5. A steering device as set forth in claim 4 wherein the steering bracket has a recess for receiving the clamping bracket.

6. A steering device as set forth in claim 5 wherein the steering bracket is affixed to the transom on the opposite side of the transom from the clamping bracket.

7. A steering device as set forth in claim 1 wherein the axes of the bore and that defined by the pivot pin are disposed closely adjacent each other.

8. A steering device as set forth in claim 7 wherein the bore axis is disposed rearwardly and below the tilt axis.

9. A steering device as set forth in claim 1 further including means for affixing one end of a push-pull cable to one end of the steering rod.

10. A steering device as set forth in claim 1 wherein the means for connecting the steering rod to the steering arm comprises a steering link.

11. A steering device as set forth in claim 10 wherein the steering link is affixed to one end of the steering rod.

* * * * *